US006349924B1

(12) United States Patent
Studebaker, Jr. et al.

(10) Patent No.: US 6,349,924 B1
(45) Date of Patent: Feb. 26, 2002

(54) SOLID ROD FENCING

(76) Inventors: Robert L. Studebaker, Jr., 6050 W. 51st St., Tulsa, OK (US) 74107; Warren F. Young, Atlas Life Building 415 S. Boston, Ste. 510, Tulsa, OK (US) 74103

( * ) Notice: Subject to any disclaimer, the term of this patent is extended or adjusted under 35 U.S.C. 154(b) by 0 days.

(21) Appl. No.: 09/475,875

(22) Filed: Dec. 30, 1999

(51) Int. Cl.[7] ..... E04H 17/14; E04H 17/16

(52) U.S. Cl. ..... 256/65; 256/73; 256/21; 256/25; 256/59; 256/23

(58) Field of Search ..... 256/27, 24, 25, 256/59, 60, 62, 73, 61, 65; 119/514

(56) References Cited

U.S. PATENT DOCUMENTS

| | | | | | |
|---|---|---|---|---|---|
| 1,182,018 | A | * | 5/1916 | Koenig | 256/25 |
| 2,696,974 | A | * | 12/1954 | Gibbs | 256/22 |
| 3,204,606 | A | * | 9/1965 | Parr et al. | 256/26 |
| 3,469,822 | A | | 9/1969 | O'Brien | |
| 3,486,739 | A | * | 12/1969 | Nelson et al. | 256/65 |
| 3,910,560 | A | * | 10/1975 | Goetz | 256/24 |
| 4,067,547 | A | | 1/1978 | Peters | |
| 4,371,148 | A | * | 2/1983 | Harden | 256/26 |
| 4,537,151 | A | | 8/1985 | Bolton | |
| 4,557,467 | A | * | 12/1985 | Lin | 256/59 |
| 4,836,143 | A | * | 6/1989 | Shadbolt, Jr. | 119/20 |
| 4,844,424 | A | | 7/1989 | Knudlien | |
| 5,100,109 | A | * | 3/1992 | Robbins, III | 256/59 |
| 5,201,498 | A | * | 4/1993 | Akins | 256/26 |
| 5,362,030 | A | * | 11/1994 | Iller, Jr. et al. | 256/65 |
| 5,402,988 | A | * | 4/1995 | Eisele | 256/24 |
| 5,615,968 | A | | 4/1997 | Verenski | |
| 5,683,074 | A | | 11/1997 | Purvis | |
| 5,803,647 | A | | 9/1998 | Hughes | |

* cited by examiner

*Primary Examiner*—Lynne H. Browne
*Assistant Examiner*—Ernesto Garcia
(74) *Attorney, Agent, or Firm*—William S. Dorman

(57) ABSTRACT

A fence structure made from steel rods approximately five eighths inch in diameter and having a tensile strength of about ninety thousand pounds, the fence structure comprising a plurality of horizontally extending and vertically spaced rods interconnected by a plurality of horizontally spaced vertical rods which are welded at their points of intersection to the horizontal rods.

2 Claims, 4 Drawing Sheets

20
36
34
28
20

20
34
28
36
30
20

34
5
5
26
20
20
20
20
3
24
X
28
28
28
28
34
3
20
20
22
20
26
Y
34

SOLID ROD FENCING

BACKGROUND OF THE INVENTION

1. Field of the Invention

The present invention relates to solid rod fencing. More particularly, this invention relates to fencing where new or used oil field sucker rods, or plain steel rods are assembled in to fence sections that can be installed on posts in 8, 12, 16, and 24 foot sections or to panels that are approximately 5 feet tall and 8 feet long.

2. Prior Art

Wood fencing has been utilized traditionally for many years to enclose areas of real estate. Typically, the main purpose of such fencing is to enclose and retain animals within a given space. Metal fencing has also been employed and more recently plastic fencing such as fence components made out of Polyvinyl Chloride (PVC). The present invention, on the other hand, utilizes new or used oil field sucker rods or plain steel rods of the similar size to create fence sections that can be installed onto posts in 8, 12, 16, and 24 foot sections. The rods are positioned to run horizontally with a perpendicular rod welded 2 feet from each end and every 3 or 4 feet in between. The sucker rods can also be made into panels to create portable livestock enclosures. The use of new or used sucker rods in such a manner is believed to be previously unknown.

A preliminary search was conducted on the above invention and the following listed patents were uncovered.

| Inventor | U.S. Pat. No. | Date |
|---|---|---|
| Purvis | 5,683,074 | Nov. 4, 1997 |
| Hughes | 5,803,647 | Sep. 8, 1998 |
| Verenski | 5,615,968 | Apr. 1, 1997 |
| Bolton | 4,537,151 | Aug. 27, 1985 |
| Peters | 4,067,547 | Jan. 10, 1978 |
| O'Brien | 3,469,822 | Sep. 30, 1969 |
| Akins | 5,201,498 | Apr. 13, 1993 |
| Knudslien | 4,844,424 | Jul. 4, 1989 |

Purvis, U.S. Pat. No. 5,683,074 discloses a temporary guard rail system which uses slip joint 16 as connection means. See Column 5, Lines 25–30, where the segment 16*d* is described as being fabricated to an outside diameter that is slightly smaller than the inside diameter of the external segment 16*e*. FIG. 7A shows the rail and the segment as being round where as FIG. 7 shows the corresponding members as being square or rectangular cross-section.

Peters, U.S. Pat. No. 4,067,547 discloses a prefabricated fence which uses slip joint connection 16 between fence sections.

Akins, U.S. Pat. No. 5,201,498 discloses a fence panel which is provided with bumpers 19. These resist the tendency of a post to sink into soft ground.

Knudslien, U.S. Pat. No. 5,844,424 discloses a fence panel which utilizes both mud feet and panel connectors 14 and 15.

SUMMARY OF THE INVENTION

New or used oil field sucker rods or plain steel rods are assembled into fence sections that can be installed onto posts in 8, 12, 16, and 24 foot sections. A predetermined number or rods (from 4 to 7) are positioned to run horizontally with a perpendicular rod welded two feet from each end and every 3 or 4 feet in between. The perpendicular rods "stays" hold the fence section together and give the entire section structural strength. Furthermore, a slip coupling is welded on one end of each rod on the same end of the panel (the female end) to enable the fence sections to be joined together in a continuous fashion. The slip coupling is made from pipe with an inside diameter that will fit snugly over the end of rod being used in the fence section. In another embodiment the sucker rods are assembled into portable livestock panels. These panels are approximately 5 feet tall and 8 feet long. A predetermined number of rods (5 to 7) 8 feet in length, are positioned to run horizontally with a perpendicular rod 5 feet in length welded to each end and known as the legs. At the lower end of the legs, the steel is bent into a 90-degree turn which then extends approximately 12 inches parallel to the upper rails. The purpose of these extensions is to prevent the panel from sinking into the mud.

DETAILED DESCRIPTION OF THE PREFERRED EMBODIMENTS

Figure 1:
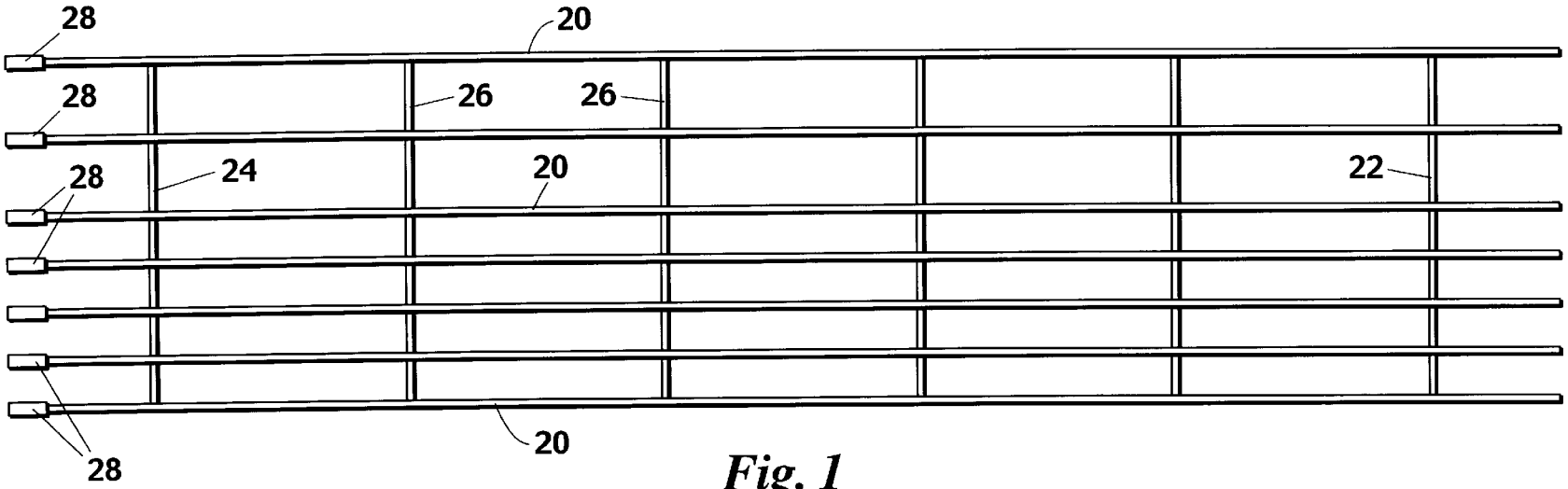
FIG. 1 is a side elevation of a fence section made from seven (7) sucker rods each approximately 24 feet in length.
Figures 2, 3, 4:
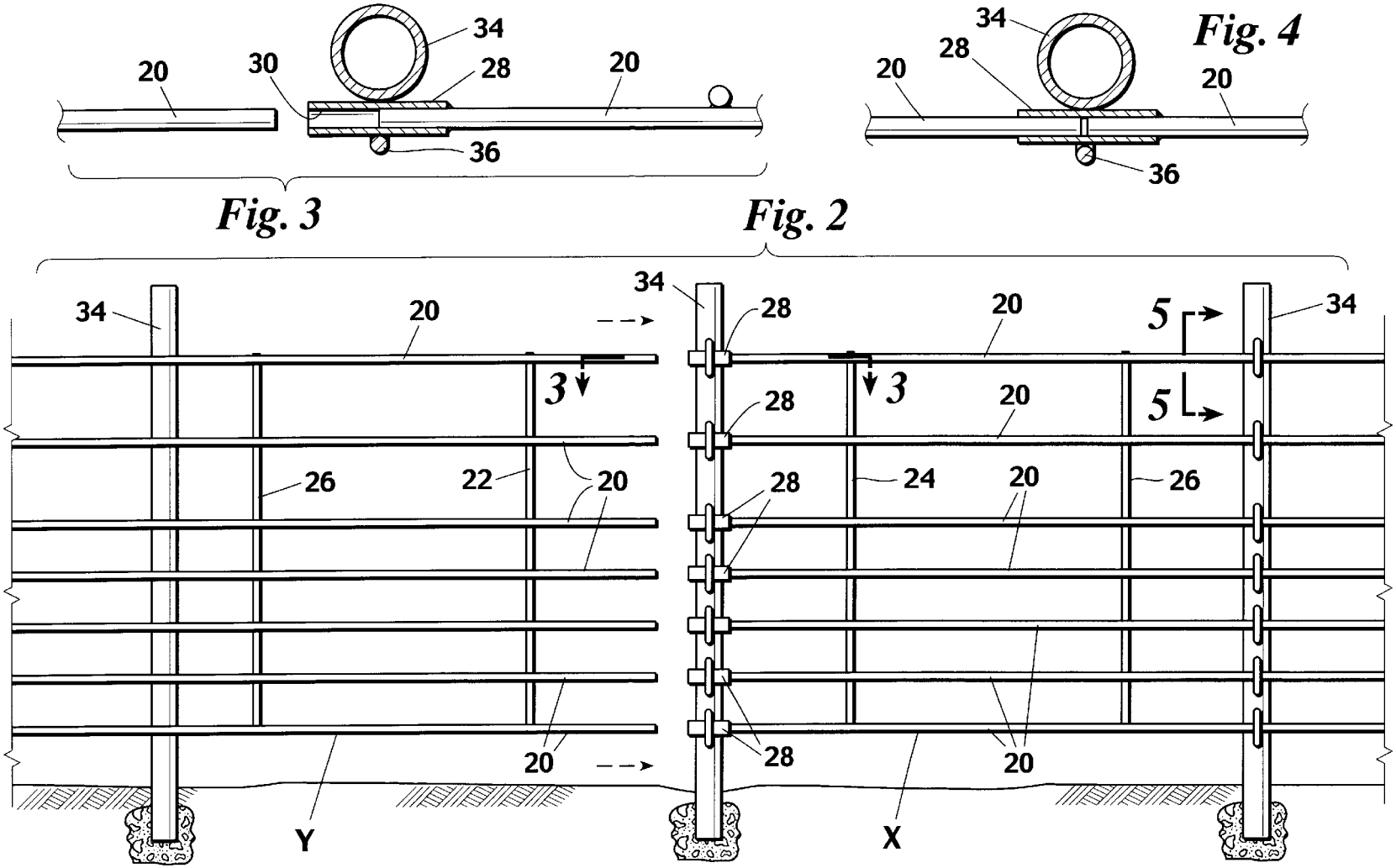
FIG. 2 is an exploded side elevation showing a right-hand fence section attached to posts and the left-hand fence section positioned to engage the left-hand end of the right fence section.
FIG. 3 is a view taken along section line 3—3 of FIG. 2 showing the rod of the left-hand fence section about to be inserted into the coupling member associated with the right-hand fence section.
FIG. 4 is a view similar to FIG. 3 but showing where the left-hand fence section has been inserted into the coupling of the right-hand fence section.

Referring to the drawings, FIG. 1 shows a plurality of sucker rods 20 that extend for approximately 24 feet. A perpendicular sucker rod 22 is attached approximately 2 feet in from the right-hand end of the section shown in FIG. 1 and another perpendicular rod 24 is positioned in 2 feet from the other end of the section. Intermediate rods 26 are positioned approximately 4 feet apart. A coupling 28 (see also FIGS. 2, 3, and 4) is welded to the left-hand end of each of the horizontal rods 20 shown in FIG. 1. As best shown in FIGS. 3 and 4, the coupling 28 is a piece of pipe having an inner diameter 30 slightly in excess of the outside diameter of the rod 20. Thus, the couplings 28 are all positioned at the left-hand end (female end) of the fence section shown in FIG. 1. This will permit the right-hand end of the fence section shown to the left in FIG. 2 to fit into the couplings 28 of the right-hand fence section shown in FIG. 2.

Figure 5:
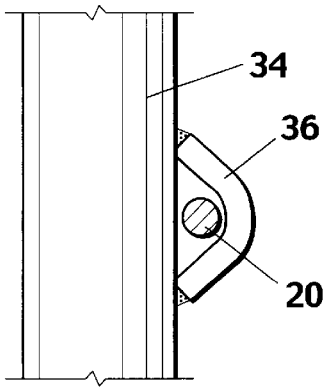
FIG. 5 is a fragmentary view taken at right angles to one of the rods showing the means of attachment of the horizontal rod to the vertical post.

As shown in FIGS. 2 through 9 the fence construction or panel of FIG. 1 is preferably attached to a series of vertical posts 34 which are preferably spaced about 8 feet apart. As best shown in FIG. 5 the individual horizontal rods 20 are attached to the vertical post 34 by means of metal clips 36 which are welded at the upper and lower ends to the post 34. At the left-hand end of the right section in FIG. 2 the clips 36 are actually welded over the couplings 28 which are positioned on the left-hand ends of the rods 20.

Figure 6:
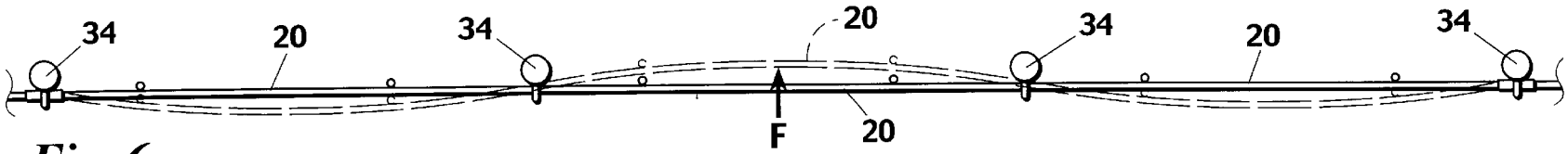
FIG. 6 is a plan view of a fence such as the right-hand portion of FIG. 2 showing how the fence can flex when force is exerted against the rods.

As shown in FIG. 6 the rods 20 give considerable flexibility to the fence, more so than a wooden fence or a PVC fence. Thus, if a force F is applied in the center of the structure shown in FIG. 6 the rod 20 will merely bow and then thereafter return to its position after the force has been removed. In addition to being flexible the rods 20 of the present invention are quite strong and durable. It should be understood that the rods 20 shown in the drawings and described herein are five eighths inch solid steel rods having ninety thousand pounds tensile strength.

Figure 8:
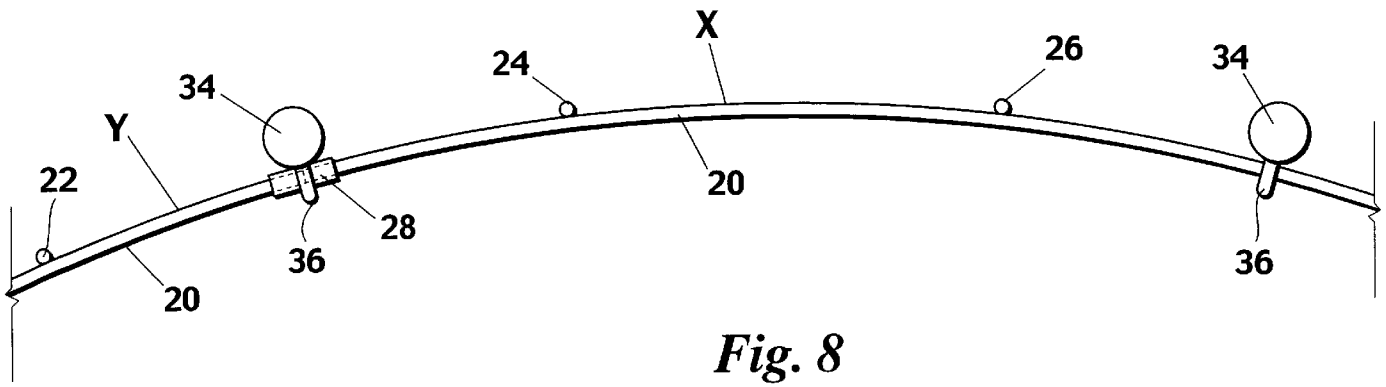
FIG. 8 is a partial and enlarged view of the fence of FIG. 7.
Figure 7:
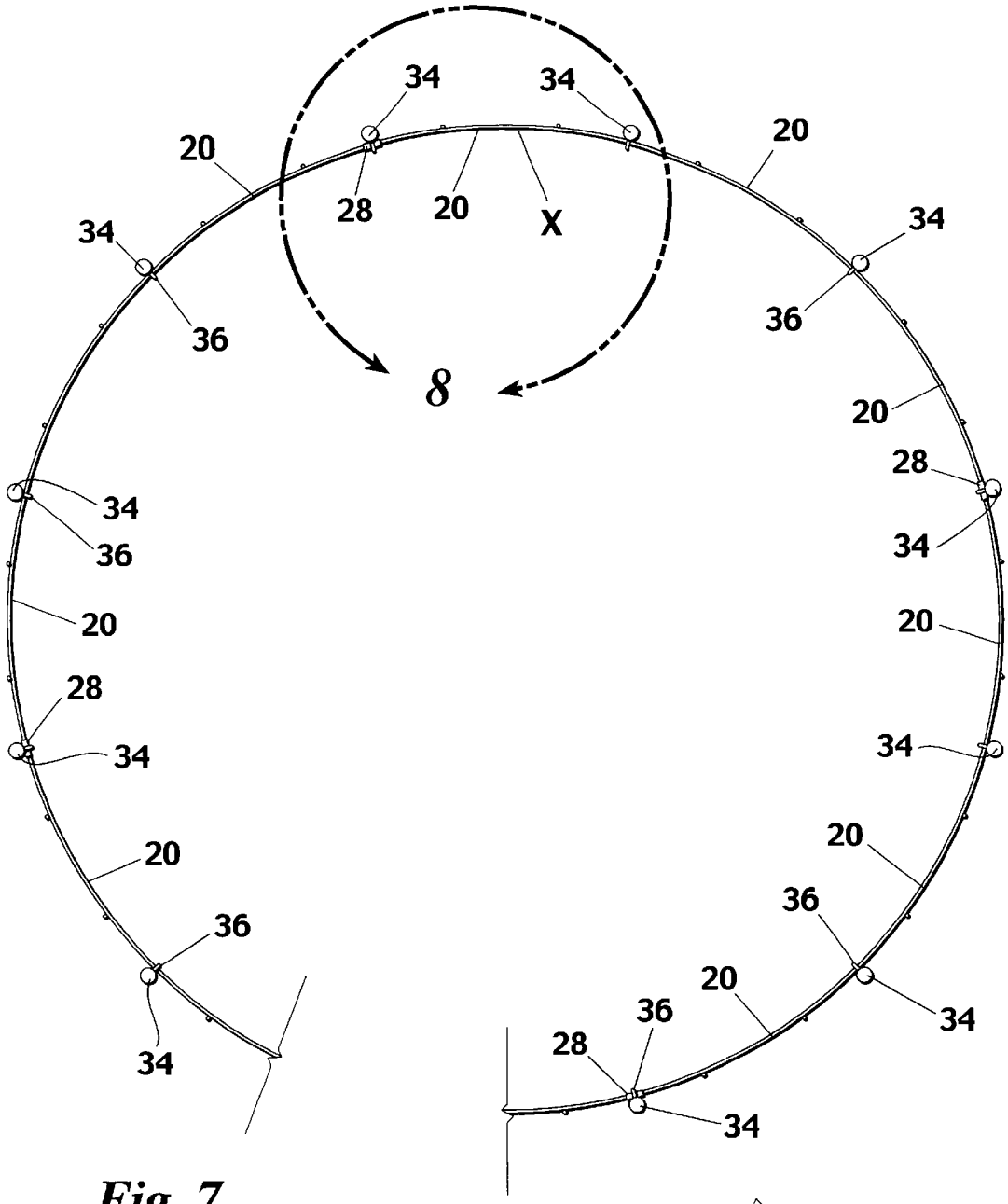
FIG. 7 is a plan view showing the fence section of FIG. 6 arranged in end to end relation and curved to form a circular enclosure.

The flexibility of the fence construction of the present invention is further shown in FIG. 7 where a series of posts 34 are arranged in a circular pattern. The manner in which the rods 20 are bent is simply that when the first segment X has been placed between a pair of posts 34, as shown in FIG. 8 and the corresponding circled portion of FIG. 7, the next adjacent portion (see now FIG. 2) Y is positioned so that the ends of the rods 20 are received in the couplings 28 of section X thereafter the section Y is bent until it can be attached to the next succeeding post and clipped in place using the clips 36.

Figure 9:
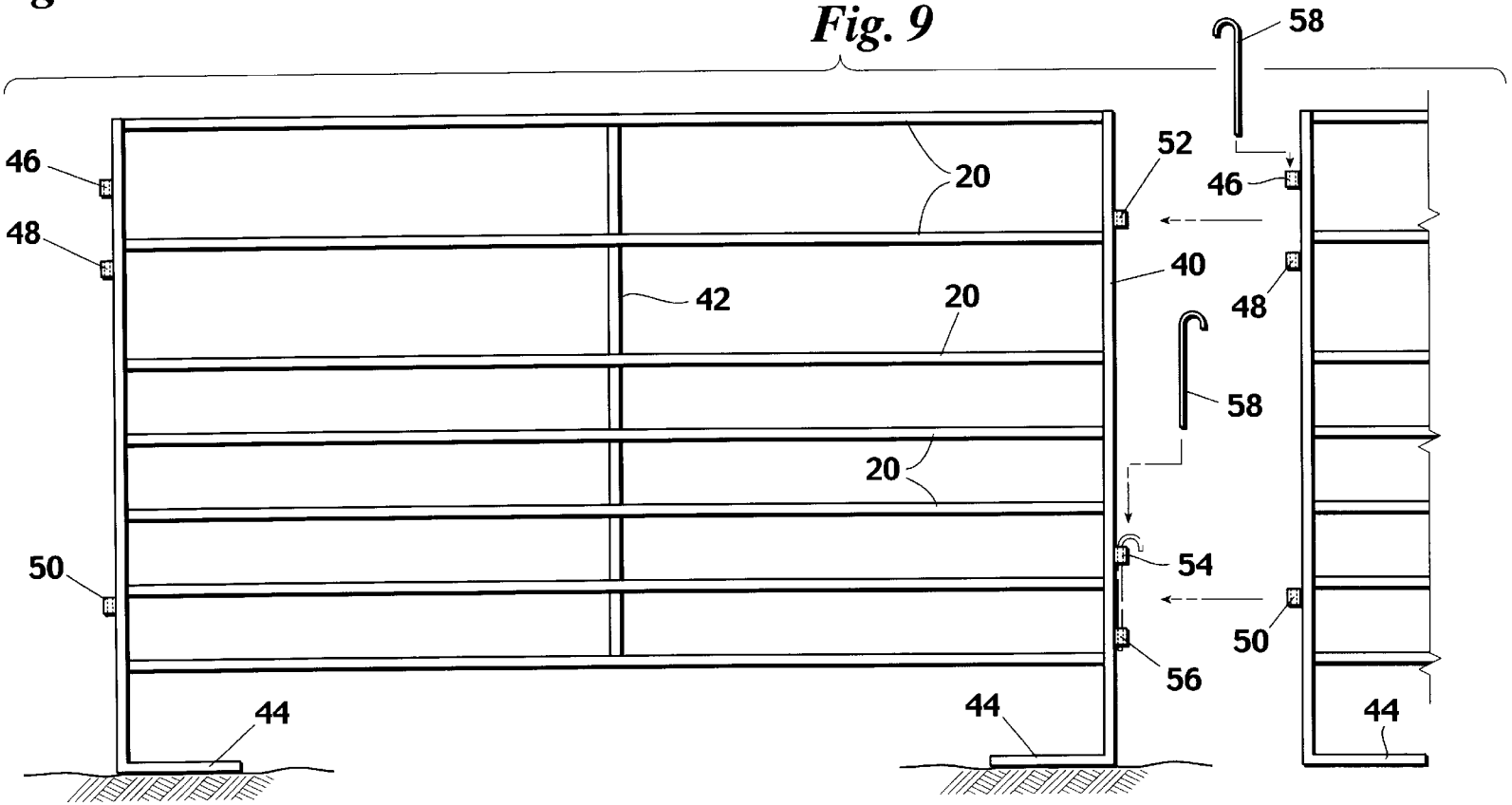
FIG. 9 is a view of a panel formed from the sucker rods used in the fence of FIG. 1 in association with another similar fence panel.

FIG. 9 shown a modification of the present invention where the sucker rods 20 are assembled in the form of a panel which can be connected to a similar panel to form a circular enclosure or pen. Thus, referring to FIG. 9, a plurality of sucker rods 20 are arranged horizontally and are connected in 8 foot lengths to vertical end rods 40 which will be further described. An intermediate vertical rod 42 connects the centers of the horizontal rods 20 in much the same manner as the rod 22 shown in FIG. 1. The rods 40 are preferably, but not necessarily, 5 feet in height. Each vertical rod 40 constitutes a leg whose lower end 44 is bent at a 90 degree angle to the main portion 40 and extends approximately 12 inches parallel to the upper rails 20. The purpose of the extension 44 is to prevent the panel from sinking into the mud. The vertical members 40 are fitted with loops 46, 48 and 50 on the left-hand member 40 of the panel and with loops 52, 54, and 56 on the right-hand rod 40 shown in FIG. 9. The purpose of these loops is to permit attachment to an adjacent and identical panel section such as shown to the right on FIG. 9. The loops 46 through 56, inclusively, are nothing more than little eyes with a hole through and welded to the rods 40. To connect the panel shown in FIG. 9 with the panel section portion shown to the right of FIG. 9, all one need do is employ a couple of J rods 58 which can be used to hold the panel sections together. Briefly, one would move the panel section to the right in FIG. 9 close to the left-hand portion until the loops 46 and 48 are positioned above and below the loop 52, at which time the upper J rod 58 is slipped through the holes of these loops. Simultaneously, the lower J rod 58 is inserted through the loops 52, 54, and 56 which are now in alignment. The panel of FIG. 9 is likewise flexible as shown in FIG. 6 where a large animal such as a horse would push against the side of the panel. The rods 20 would merely flex and not break.

What is claimed is:

1. A fence structure comprising a plurality of horizontally extending and vertically spaced, horizontal flexible steel rods interconnected by a plurality of horizontally spaced, vertical flexible steel rods which are welded at their points of intersection to the horizontal rods, wherein a predetermined number of said horizontal rods of a predetermined length and which are connected by said vertical rods is defined as a fence section, one end of said fence section being a male end and the other end being a female end, a plurality of coupling members, at least one of the coupling members attached to one of the horizontal rods at the female end, each coupling member consisting of a piece of steel pipe having an inner diameter equal to the outer diameter of the horizontal rods and having two opposite ends, the at least one coupling member having one end thereof inserted onto and welded over the end of the one of the horizontal rods with the other end of the at least one coupling member being an open end, the open end of the at least one of the coupling members at the female end being adapted to receive a rod end of a male end of an adjacent fence section, a plurality of vertical posts disposed in spaced horizontal relation, the horizontal rods being clipped to a side of the posts.

2. A fence structure as set forth in claim 1 wherein the fence section can be bent into a circular arrangement.

* * * * *